US006428225B1

(12) United States Patent
Nguyen et al.

(10) Patent No.: US 6,428,225 B1
(45) Date of Patent: Aug. 6, 2002

(54) PRINTER CASSETTE WITH LABEL STOCK TENSIONER ARM AND ASSOCIATED PRINTER

(75) Inventors: Long Su Nguyen, Kettering; William Howard McMahon, Ludlow Falls; John Wendell Bowman, Fairborn; Robert Merle Frow, Kettering, all of OH (US)

(73) Assignee: Premark FEG L.L.C., Wilmington, DE (US)

( * ) Notice: Subject to any disclaimer, the term of this patent is extended or adjusted under 35 U.S.C. 154(b) by 0 days.

(21) Appl. No.: 09/507,075

(22) Filed: Feb. 18, 2000

(51) Int. Cl.[7] ..... B41J 15/16; B41J 15/04

(52) U.S. Cl. ..... 400/613; 400/618; 101/288

(58) Field of Search ..... 400/613, 614, 400/615.2, 618; 101/288; 156/384

(56) References Cited

U.S. PATENT DOCUMENTS

| | | | | |
|---|---|---|---|---|
| 2,432,202 A | | 12/1947 | Mason | 101/227 |
| 2,909,301 A | | 10/1959 | Fritzinger | 156/494 |
| 4,026,758 A | | 5/1977 | Sato | 156/540 |
| 4,129,473 A | | 12/1978 | Perret | 156/364 |
| 4,450,036 A | | 5/1984 | Volk | 156/387 |
| 4,718,971 A | | 1/1988 | Summers | 156/540 |
| 4,927,278 A | | 5/1990 | Kuzuya et al. | 400/208 |
| 5,165,806 A | * | 11/1992 | Collins | 400/120 |
| 5,168,814 A | | 12/1992 | Kuzuya et al. | 101/487 |
| 5,195,691 A | | 3/1993 | Pfeiffer et al. | 242/417 |
| 5,346,580 A | | 9/1994 | Elges et al. | 156/540 |
| 5,435,657 A | * | 7/1995 | Pearce et al. | 400/208 |
| 5,533,818 A | * | 7/1996 | Bahrabadi | 400/208 |
| 5,553,952 A | | 9/1996 | Umbach | 400/208 |
| 5,619,237 A | * | 4/1997 | Inoue et al. | 347/86 |
| 5,772,840 A | | 6/1998 | Morinaga | 156/540 |
| 5,882,126 A | | 3/1999 | Bowling | 400/55 |
| 5,918,992 A | | 7/1999 | Matsuhashi et al. | 400/615 |

FOREIGN PATENT DOCUMENTS

| | | | | |
|---|---|---|---|---|
| EP | 0179501 A1 | | 10/1984 | |
| EP | 0258022 A1 | | 8/1986 | |
| EP | 0656262 A1 | | 12/1987 | |
| EP | 0914960 A2 | | 10/1997 | |
| JP | 6-115234 A | * | 4/1994 | 400/613 |
| WO | WO 99/20473 | | 10/1997 | |

OTHER PUBLICATIONS

Machine–Assisted Translation of Japanese Publication No. 6–115234.

Invitation to Pay Additional Fees and Partial International Search Report regarding corresponding PCT International Application No. PCT/US01/04010 (issued Jul. 6, 2001).

* cited by examiner

*Primary Examiner*—Daniel J. Colilla
(74) *Attorney, Agent, or Firm*—Thompson Hine LLP

(57) ABSTRACT

A printer media cassette includes a movable arm which defines a desired path for media stock to facilitate insertion and removal of the cassette from a printer. The cassette also includes a tensioner arm for providing slack in the media path within the cassette to account for slippage between a feed roller of the printer and the media. Latching mechanisms on the cassette cooperate with latching mechanisms on a printer to assure proper installation of the cassette within the printer.

27 Claims, 6 Drawing Sheets

PRINTER CASSETTE WITH LABEL STOCK TENSIONER ARM AND ASSOCIATED PRINTER

TECHNICAL FIELD

The present invention relates generally to printers and, more particularly, to a label stock cassette and label printer with features which aid installation and securing of the cassette into the printer, and improved label stock delivery during a printing operation.

BACKGROUND OF THE INVENTION

Label printers commonly utilize a media stock in the form of a roll of a backing material with labels affixed thereto, where the labels can be easily peeled from the backing material after passing by a print head assembly which prints information on the labels. In some printers media cassettes are used to supply the label stock, where the cassette includes a supply roll of label stock and a take up roll which receives a backing material of the label stock after labels have been printed and peeled therefrom. The label stock backing follows an angled path out of an opening in the cassette, around the print head assembly and back into the cassette to the take up roll. If the cassette is removed from the printer before the label stock supply is expended, reinsertion of the cassette is impeded by the need to attain the proper label stock path around the print head assembly. Accordingly, it would be desirable to provide a media cassette which facilitates placement of the label stock around the print head assembly upon insertion into the printer.

The label stock in such printers is typically fed past the print head by a rotatable feed roller which contacts the label stock and presses the label stock against the print head. In some situations, particularly where the supply roll of label stock is relatively large, when the feed roller first moves in order to begin movement of the label stock past the print head, the torque required to rotate the supply roll is sufficient enough to cause some slippage of the feed roller relative to the label stock. The result is typically seen as a compressed printed image on the label. Accordingly, it would be desirable to provide a media cassette which accounts for high torque loads generated by initial rotation of the supply roll.

As label stock cassettes get larger, installation and removal of the cassette becomes more difficult due to increased weight. It would therefore be desirable to provide a media cassette adapted for easier installation and removal, and it would also be desirable to provide a printer which is adapted for easier cassette installation, securing and removal.

SUMMARY OF THE INVENTION

In one aspect of the invention, a printer cassette installable in a printer includes a housing having a first media stock mount for positioning a roll of media stock thereon and a second media stock mount for holding a collection roll which receives a backing material of the media stock. An opening is provided in the housing, and an arm extends from the housing proximate to the opening for passing a loop of media stock therearound in position to be inserted into the printer along an intended path. The arm is biased into an extended position and retractable upon contact with a portion of the printer upon insertion of the cassette into the printer. Thus, the retractable arm locates the media stock in a proper orientation for being passed around the feed roller and stripper element of a print head assembly and therefor facilitates installation of the cassette into the printer. Various configurations of the arm are provided.

In another aspect of the invention, a printer includes a housing having a cassette receiving cavity, with a slot positioned along a peripheral surface of the cavity. A cassette latch member is positioned within the slot for holding a cassette within the cavity. A handle is connected with the latch member for effecting movement of the latch member. The latch member is movable between a latching position and a non-latching position, where the latch member extends from the slot into the cavity when in the latching position. The latch member is configured to engage a slot on the cassette when the cassette is inserted within the cavity. Preferably, the latch member includes a cam surface which cooperates with the cassette slot to pull the cassette into a secure position within the printer cavity.

In a further aspect of the present invention, a printer for printing labels includes a housing defining a cavity and a cassette positioned within the cavity, the cassette containing a supply roll of label stock. A print head assembly of the printer includes a label stock feed roller for feeding label stock past a print head of the assembly. A tensioner arm is positioned along a label stock path between the supply roll and the print head assembly. The tensioner arm contacts the label stock and is flexible to vary a label stock path according to a tension in the label stock during feed. The tensioner arm is positioned to for a normal label stock path which includes slack. When the torque required to move the supply roll and thus the tension of the label stock between the feed roller and the supply roll exceeds a certain level, the tensioner flexes or moves to allow the slack to be fed past the print head in order to reduce or prevent compressed printed images.

DETAILED DESCRIPTION

Figure 1:
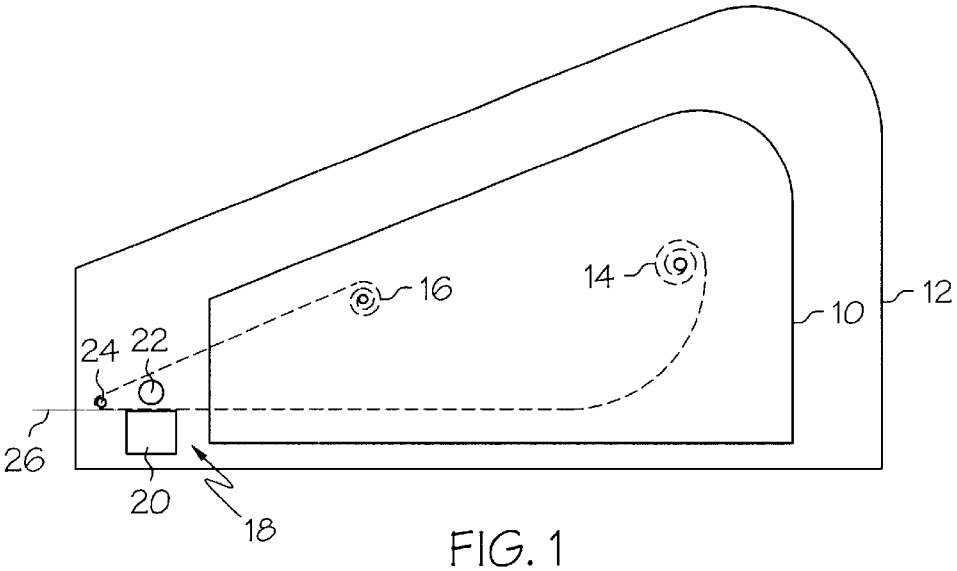
FIG. 1 PRIOR ART
FIG. 1 is a schematic side view of a printer and associated cassette.

Referring to FIG. 1, a schematic side view of a label stock cassette 10 installed within a printer 12 is shown. The cassette 10 includes a rotatable supply roll 14 of label stock and a take up roll 16 for receiving the backing which returns from a print head assembly 18 located near a front of the printer 12. The print head assembly 18 includes a print head 20 for printing indicia on the labels which face downward, a feed roller 22 positioned above the print head 20 and biased against the print head 20, and a stripper element 24 for causing labels to peel away from the label stock backing material. The labels 26 typically exit through a slot in the front of the printer housing as shown. A controller (not shown) controls movement of the feed roller 22 via a motor (not shown) and also controls movement of the take up roll 16 via a toothed belt drive (not shown) which is driven by the motor through an associated slip clutch (not shown). Alternatively, a separate control motor could be provided to drive the take up roll 16. This set up depicted in FIG. 1 is generally known and illustrates the looped path which the label stock backing takes around the print head assembly 18. This looped path can present cassette installation problems as mentioned above.

Figure 2:
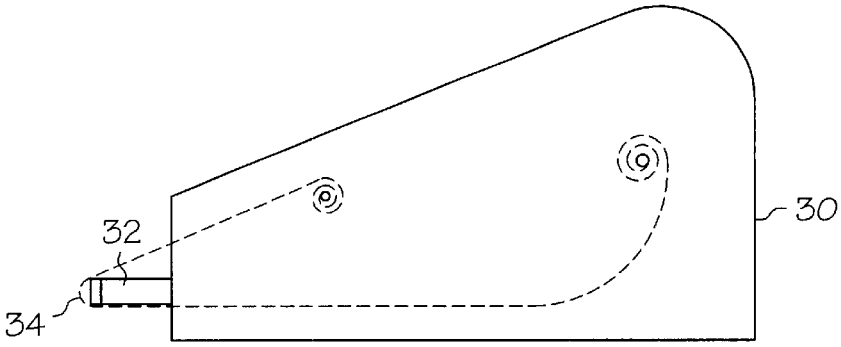
FIG. 2 is a side view of one embodiment of a cassette according to the present invention.
Figure 3:
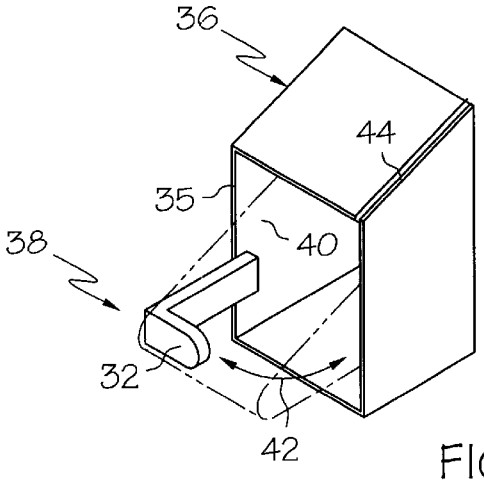
FIG. 3 is a partial front perspective view of the cassette of FIG. 2.

Accordingly, referring to FIG. 2, an improved printer cassette 30 is provided having a label path arm 32 for extending a loop 34 of the label stock therearound. As shown, the looped orientation of the label stock around the arm 32 corresponds to the loop the label stock takes around the print head assembly 18 when the cassette is installed in a printer 12. In one embodiment, the arm 32 is L-shaped as shown in the partial perspective view of FIG. 3 and is pivotably mounted to a printer side 35 of the cassette housing 36. Upon installation of the cassette 30 into a printer 12, the arm 32 contacts a portion of the print head assembly 18 generating a force against the arm 32 as indicated by arrow 38. In response, the arm 32 rotates or otherwise retracts inward toward the cassette housing opening 40 as indicated by arrow 42, allowing the cassette to be inserted while at the same time providing a label stock path suitable to be passed around the feed roller 22 and the stripper element 24 of the print head assembly 18 as necessary. It is recognized that the label path arm 32 could contact some other structure within the printer to achieve the same result. For example, the printer housing might include a special ledge for contacting the label path arm 32. The cassette 30 also includes a door 44 at its exterior side for enabling access to the interior of the cassette.

Figure 5:
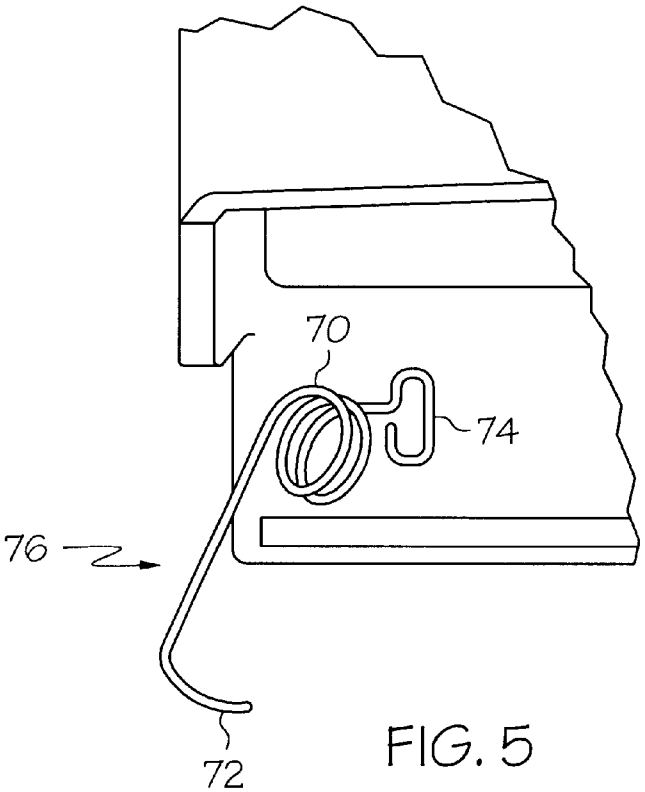
FIG. 5 is a partial detailed view of another embodiment of a pivoting label path arm.
Figure 4:
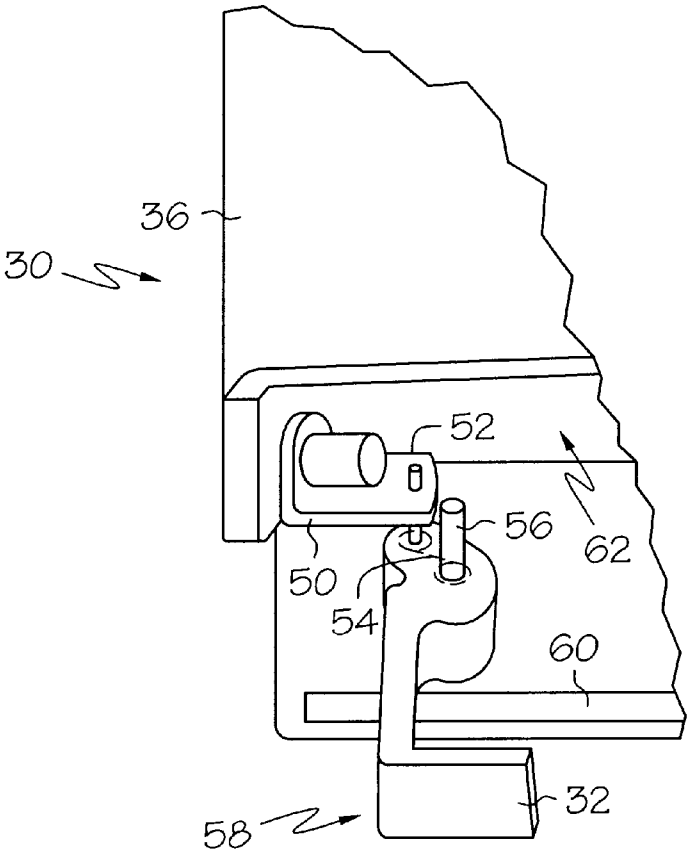
FIG. 4 is a partial detailed view of one embodiment of a pivoting label path arm.

A more detailed depiction of one pivotable arm embodiment is shown in FIG. 4 where a partial front view of a cassette 30 is provided. A mounting bracket 50 connects to the cassette housing 36 at the printer side 35. A pivot pin 52 extends downward from the bracket 50 to a point on the arm 32. The pivot pin 52 is rotatably connected to the bracket 50 and fixedly connected to the arm 32. A torsion spring 54 is positioned between the bracket 50 and the arm 32 around the pivot pin 52, and includes an end segment which extends about a projection 56 extending upward from the arm 32. The other end segment of the spring 54 engages the bracket 50. The projection 56 acts as a torque application point of the arm 32, with the torsion spring 54 urging the arm 32 into the illustrated extended position via its action on the projection 56. A sufficient lateral force 38 against the side of the arm 32 acts against the torsion force of the torsion spring 54 and causes the arm 32 to rotate or pivot inward toward the front of the cassette 30. The bracket 50 is preferably of a metallic material as are the pivot pin 52 and the projection 56. The arm 32 is preferably of molded plastic construction. Also illustrated are a lower opening in the form of a slot 60 through which the label stock from the supply roll is fed from within the cassette 30 and an upper opening 62 for feeding the label stock backing material back into the cassette 30 and onto the take up roll. It is recognized that other pivotable arm arrangements are possible. A simplified variation would utilize a coil spring 70 having an end 72 which extends outward from the front of the cassette as shown in FIG. 5. The interior end 74 of the coil spring 70 could be glued or otherwise secured to the cassette. The coil spring extension 76 acts as the label stock arm. Other pivot arm arrangements could be provided, including arrangement in which the arm pivots in a different direction.

Figure 6:
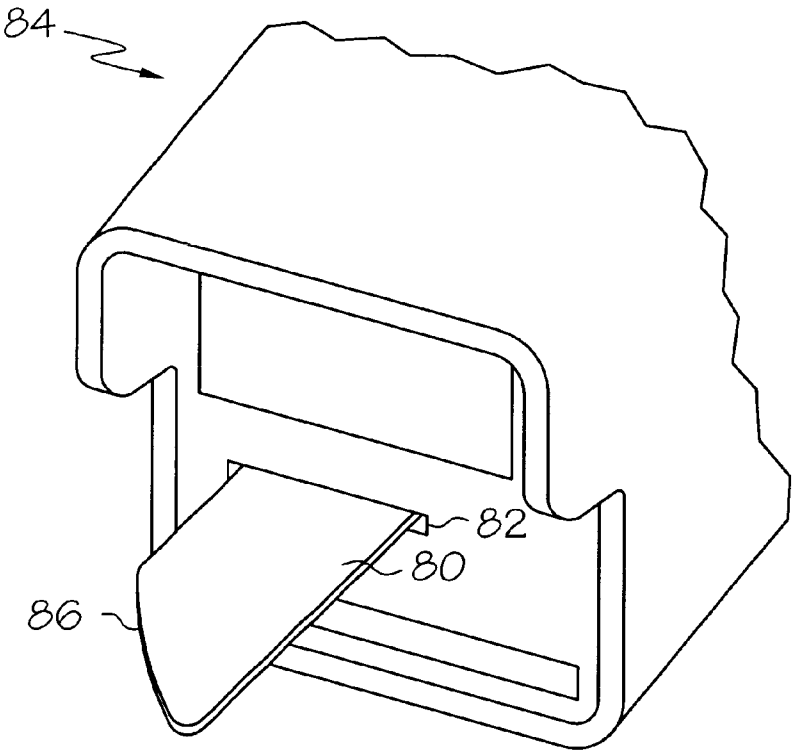
FIG. 6 is a partial detailed view of one embodiment of a sliding label path arm.

While a pivotable arm may be preferred, non-pivoting arms could be utilized to achieve a similar result. Referring now to FIG. 6, a sliding arm 80 is illustrated extending from slot 82 at the front of a cassette 84. The arm 80 may be spring-loaded outward and includes an angled surface 86 which acts as a cam surface when the cassette is inserted within a printer. In particular, the cam surface 86 contacts the feed roller of the print head assembly 18 or other portion of the printer and slides relative thereto so as to be pushed rearward into the slot 82. It is recognized that other sliding arm configurations could be utilized.

Figure 7:
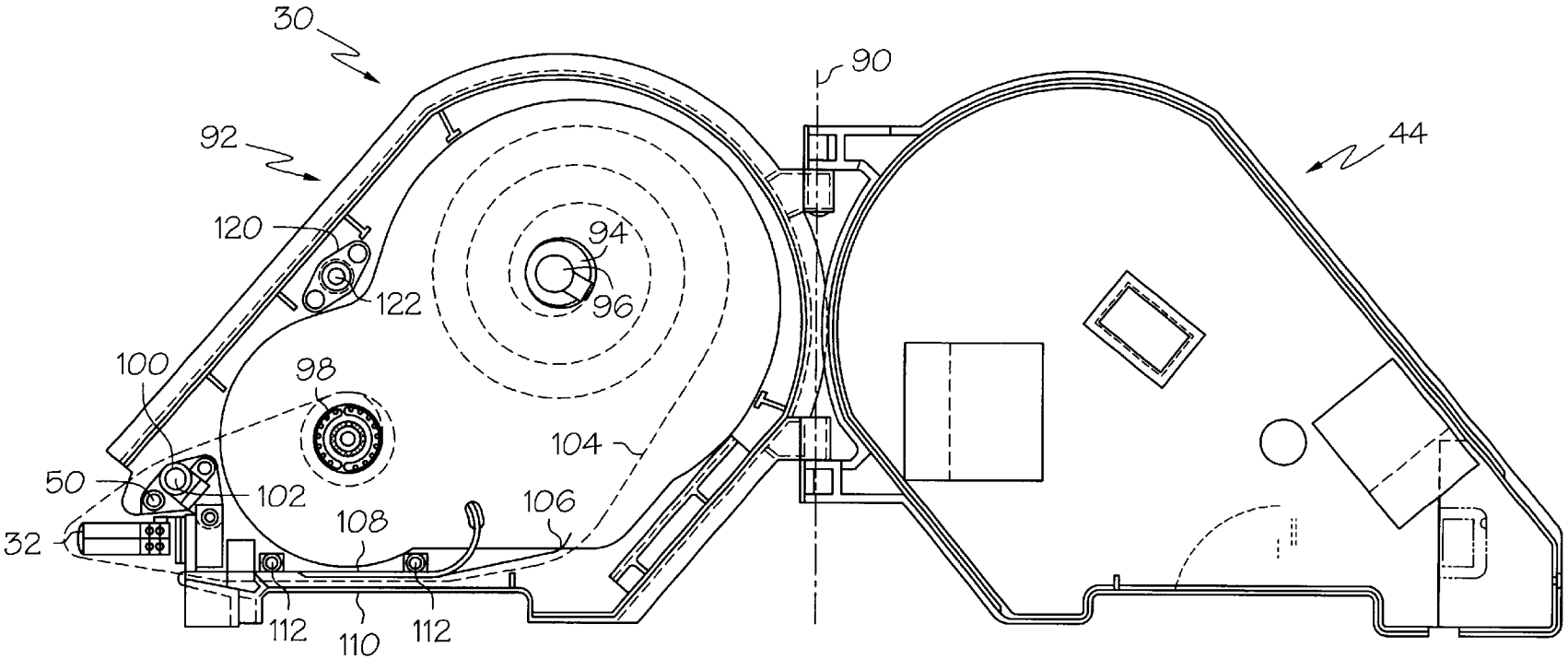
FIG. 7 is a side view of the interior of a cassette.

An exemplary open cassette 30 is illustrated in FIG. 7 where the cassette door 44 is shown pivoted in the open position about its pivot axis 90. The interior of the cassette body 92 includes a mount 94, such as a boss, extending from the printer side of the body 92 for receiving a supply roll of label stock. The mount 94 includes a central opening 96. A lower, forwardly positioned mount 98 is provided for a take up roll which receives the label stock backing, and the mount 98 is rotatable via interconnection with a shaft of a printer when installed therein. A central opening of a boss 100 forms a guide channel 102 for aid in positioning the cassette 30 within a printer via cooperation with a guide post extending from the printer cassette cavity. Boss 100 also serves as a guide for the backing paper to keep it away from other components in the cassette.

Figure 8:
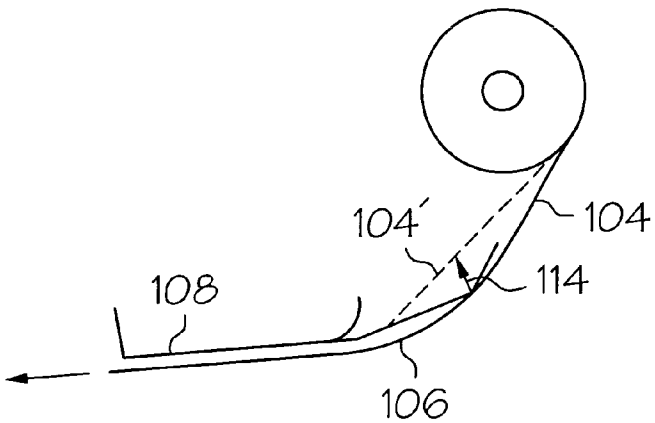
FIG. 8 is a schematic view of a label path of the cassette of FIG. 7.

A label path 104 is shown in dashed lines and extends from the supply roll location under a tensioner arm 106 which extends from a guide plate 108 positioned above the bottom surface 10 of the cassette body housing. The guide plate 108 is rigidly mounted to the printer side of the body housing via fasteners 112. As label stock supply rolls become larger, the feed roll torque needed to overcome the inertial force of the supply roll at rest increases and can cause the feed roller 22 of the printer to slip relative to the label stock. The tensioner arm 106 of the cassette 30 is intended to compensate for this problem by creating slack in the label stock path. In particular, referring to the schematic of FIG. 8, the tensioner arm 106 is shown in a normal position with label stock 104 extending thereunder. The tensioner arm flexes about the end of the guide 108 in the upward direction as indicated by arrow 114 when the tension in the label stock becomes large enough, and a shorter label stock path 104' results. Accordingly, as the tensioner arm 106 moves the slack in the label stock path is fed in by the feed roller 22 reducing slippage of the feed roller relative to the label stock and therefore reducing or eliminating the compression of printed images that can result from such slippage. The tensioner arm 106 is preferably formed by an elongated thin, flexible metal sheet material, and may be adhesively connected to the underside of the guide plate 108 by, for example, a double sided adhesive tape or foam.

Figure 9:
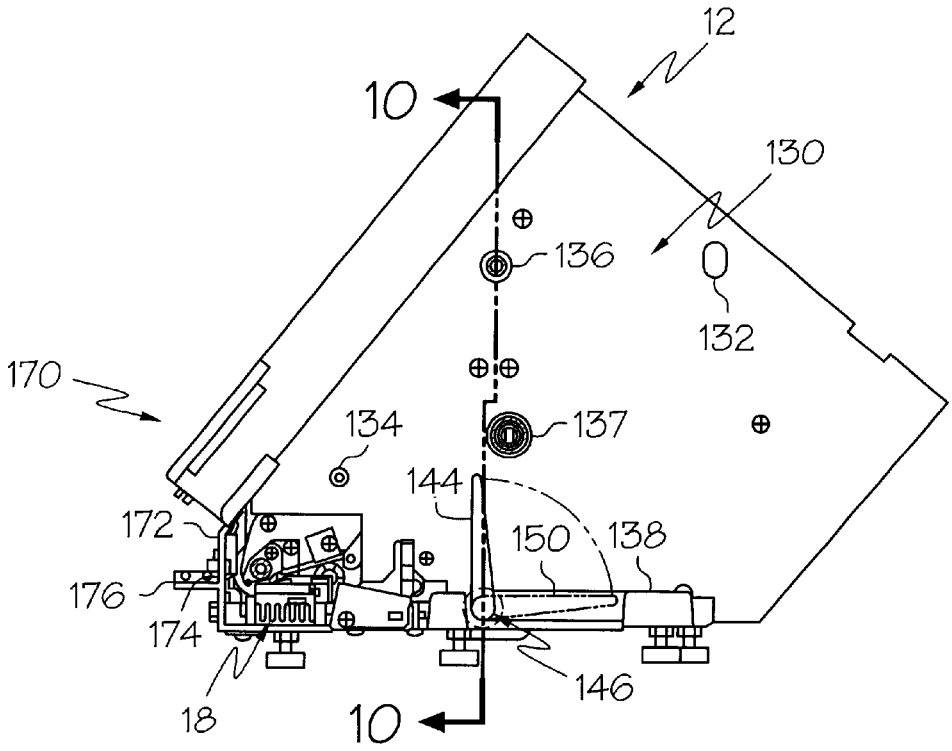
FIG. 9 is a side view of a printer.
Figure 10:
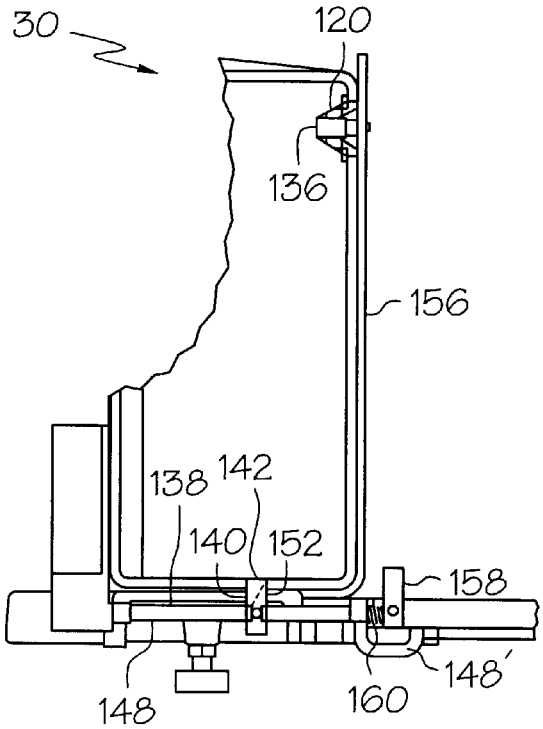
FIG. 10 is a partial cross-sectional view of a printer with cassette inserted therein taken along line 10—10 of FIG. 9.

The cassette body also includes a latch member 120 in the form of a female portion of a latch stud, latch opening 122 combination. The latch member 120 is positioned on the printer side of the cassette body 92 for receiving a latch stud which extends from the printer. In this regard, reference is made to FIG. 9 where a side view of a printer 12 is shown. The housing of the printer 12 includes a cassette receiving cavity 130 formed in the side thereof. A support and guide stud 132 extends outward from an inner side of the cavity for positioning within the opening 96 of cassette mount 94, and a guide stud 134 for positioning within the opening 102 of cassette mount 100. The two guides facilitate sliding of a cassette into the cavity 130. A latch stud 136 extends from the inner side of the cavity 130 for mating with the cassette latch member 120. Drive shaft 137 for the take up roll of the cassette is also shown. The latching combination formed by stud 136 and member 120 is preferably of the press fit or snap fit type. For example, a cabinet style latch may be used. Stud 136 extends into the cassette as generally shown in the partial side view of FIG. 10.

A bottom surface 138 of the cavity 130 is provided for resting the bottom of the cassette thereon as the cassette is slidingly inserted into the cavity 130. The bottom surface 138 includes a slot or recess 140 formed therein with a latch member 142 positioned in the slot 140. A handle 144 at the outer side of the cavity 130 pivots about point 146 where a shaft 148 extends from the handle 144 inward under the bottom surface 138 of the cavity 130 to the latch member 142 which rotates with the shaft 148. The latch member is eccentrically connected to the shaft such that when the handle is in a horizontal or down position 150 the latch member is recessed in the slot 140 in a non-latching position and when the handle is in an upright position the latch member 142 extends from the slot 140 to provide a latching position. The bottom surface of the cassette housing/body includes a slot 152 positioned for alignment with the printer slot 140 so that when the latch member 142 extends through slot 140 and into cassette slot 152 for preventing the cassette 30 from sliding out of the cavity 130.

Figure 11:
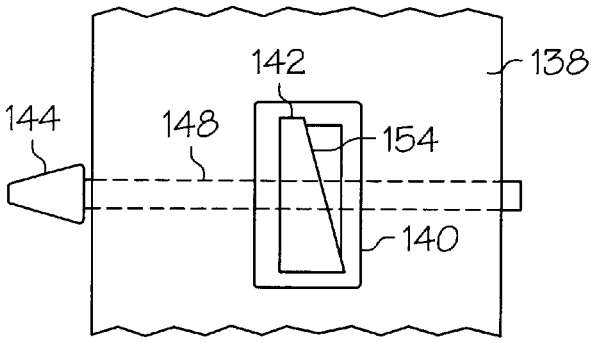
FIG. 11 is an enlarged view of one embodiment of a printer cassette latching mechanism.

As shown in the enlarged partial top view of FIG. 11, the latch member 142 preferably includes a cam surface 154 at its inner side for engaging a side edge of the cassette slot 152. Thus, as the handle 144 is progressively rotated to the upright position the cam surface 154 contacts the side edge of the cassette slot 152 and pulls the cassette 30 into the cavity 130 against the inner surface of the cavity 130. The inner surface of the cavity is formed by a fixed plate 156. The shaft 148 extends inward past the latch member 142 and connects, via segment 148', to a pivot block 158 located on the other side of fixed plate 156. A compression spring 160 or other biasing member is positioned between the pivot block 158 and the fixed plate 156 (or some other fixed structure of the printer) and therefore biases the shaft 148 inward. Thus, the latch member 142 is also biased inward when engaging a cassette slot 152.

As the handle 144 rotates to position 150, a linkage mechanism which extends to the feed roller 22 can be used disengage the feed roller 22 from the print head 20 to provide an unobstructed path for the label stock loop to load or unload the cassette.

Figure 12:
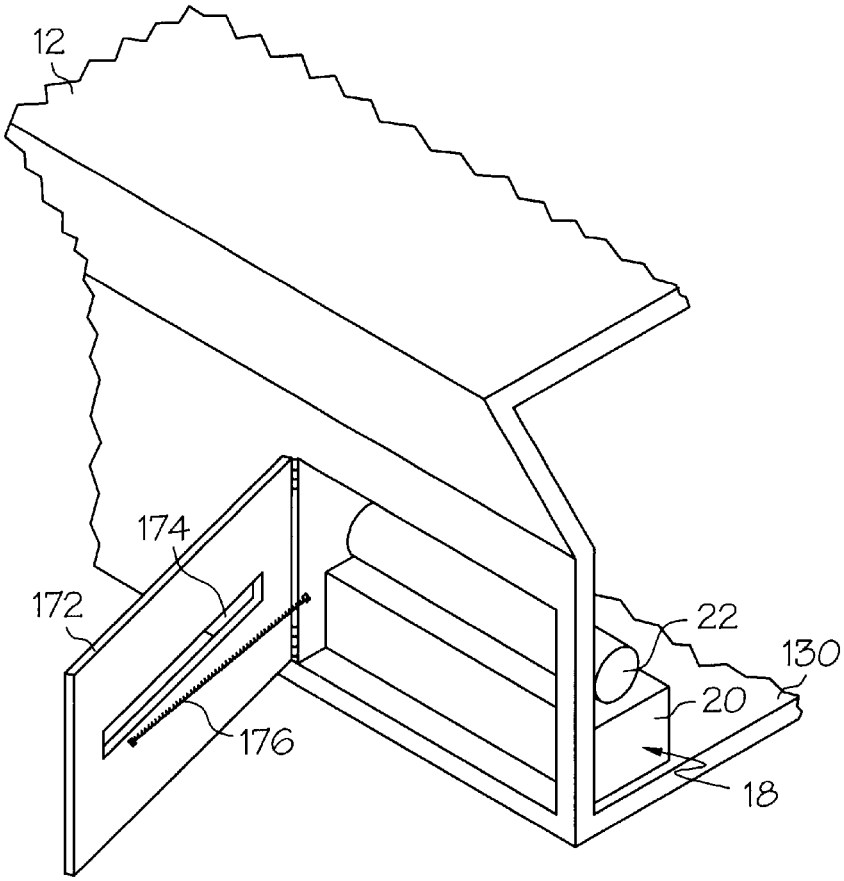
FIG. 12 is a partial top view of a bottom support surface of a printer cassette cavity.

Referring again to FIG. 9, the front side 170 of the printer 12 includes a hinged door 172 having a slot 174 for allowing printed labels to pass therethrough. A label support surface 176 receives the printed labels. As best seen in the partial perspective view of FIG. 12, an extension spring 176 extends from the door to the printer 12 to bias the door 172 in the closed position. Alternatively, torsion biased hinges could be utilized. The door 172 provides access to the interior of the printer 12, particularly to the print head assembly for maintenance and other adjustments and for cleaning.

Although the invention has been described above in detail referencing the preferred embodiments thereof, it is recognized that various changes and modifications could be made without departing from the spirit and scope of the invention. For example, while the foregoing description has been primarily with reference to label printers and label stock cassettes it is recognized that the various inventive features may have applicability to other types of printers and their associated cassettes and the therefore the scope of the invention is not intended to be limited to label printers and label stock cassettes unless otherwise specified in the claims which follow.

What is claimed is:

1. A printer cassette installable in a printer, comprising:

a housing;

a first media stock mount within the housing for positioning a roll of media stock thereon;

a second media stock mount within the housing for holding a collection roll which receives a backing material of the media stock;

at least one opening in the housing; and an arm extending from the housing forward of the opening for passing a loop of media stock therearound in position to be inserted into the printer along an intended path, the arm biased into an extended position and retractable upon contact with a portion of the printer upon insertion of the cassette into the printer.

2. The printer cassette of claim 1 wherein the arm is pivotably mounted toward a first side of the housing such that the arm is pivotable inward toward the housing opening.

3. The printer cassette of claim 2 further comprising a torsion spring biasing the arm into the extended position.

4. The printer cassette of claim 3 comprising a mounting bracket connected to the housing, the arm extending from the mounting bracket and pivotably mounted thereto.

5. The printer cassette of claim 1 wherein the arm is slidably mounted to the cassette.

6. The printer cassette of claim 5 wherein the arm includes a cam surface for effecting a sliding movement of the arm when the cassette is inserted into the printer.

7. The printer cassette of claim 1 wherein the arm is L-shaped.

8. The printer cassette of claim 1, further comprising:

a label stock guide plate positioned above a bottom surface of the cassette housing and extending toward the opening, the guide plate having an end spaced from the first mount; and a label stock tensioner arm extending from the end of the guide plate for passing label stock thereunder, the tensioner arm being flexible to vary a label stock path according to a tension in the label stock during feed.

9. The printer cassette of claim 1, further comprising:

a positioning slot formed in a bottom surface of the housing for receiving a retractable latch mechanism of the printer when the cassette is inserted therein.

10. The printer cassette of claim 9, further comprising at least one latch opening on a printer side of the housing for mating with a corresponding latch stud positioned in the printer.

11. A printer cassette installable in a printer, comprising:

a supply of label stock;

a housing containing the supply of label stock and having at least one opening for enabling label stock to pass therethrough;

an arm extending from the housing proximate to the opening, a loop of label stock passing around the arm in position to be inserted into the printer along an intended path, the arm biased into an extended position and retractable upon insertion into the printer.

12. A printer cassette installable in a printer, comprising:

a housing having at least one opening for enabling label stock to pass therethrough, an arm extending from the housing proximate to the opening for passing a loop of label stock therearound in position to be inserted into the printer along an intended path, the arm biased into an extended position and retractable upon insertion into the printer; and a label stock tensioner arm within the housing for passing label stock thereunder and toward the opening, the tensioner arm being flexible to vary a label stock path according to a tension in the label stock during feed.

13. The printer cassette of claim 12, further comprising:

at least one snap fit latch member on a printer side of the housing for mating with a corresponding snap fit latch member positioned in the printer.

14. The printer cassette of claim 13 wherein the snap fit latch member of the cassette comprises a latch opening for mating with a latch stud in the printer.

15. A printer, comprising:

a housing having a cassette receiving cavity;

a slot positioned along a peripheral surface of the cavity;

a cassette latch member positioned within the slot for holding a cassette within the cavity;

a handle connected with the latch member for effecting movement thereof, the latch member movable between a latching position and a non-latching position, the latch member extending from the slot into the cavity when in the latching position; and wherein the latch member includes a cam surface for pulling a cassette into position within the cavity as the latch member is moved from the non-latching position to the latching position;

wherein the latch member is biased toward an inner side of the cavity when in the latching position.

16. The printer of claim 15 wherein the handle is connected to the latch member by a rod which extends past the latch member to a pivot block, a spring being positioned adjacent the pivot block for urging the rod and latch member inward.

17. The printer of claim 15 wherein the handle extends in an upward manner when the latch member is in the latching position, for being positioned adjacent a side of a cassette inserted within the cavity.

18. The printer of claim 15, further comprising:

at least one latch stud extending from an inner surface of the cavity for mating with a corresponding latch opening positioned on a cassette.

19. A printer, comprising:

a housing having a cassette receiving cavity;

a cassette within the cassette receiving cavity;

a print head assembly located toward a label exit side of the cassette receiving cavity; and a door on a label exit side of the housing moveable between a closed position and an open position, the print head assembly adjacent the door, the door having a label exit slot therein and the door providing access to the print head assembly when the door is in the open position and without removing the cassette from the cassette receiving cavity.

20. The printer of claim 19 wherein the door is biased in the closed position by a spring member.

21. A printer for printing labels, comprising:

a housing defining a cavity;

a cassette containing a supply of label stock, the cassette positioned within the cavity;

one of the cavity and the cassette including a latch slot formed therein with a latch member positioned within the slot for holding the cassette within the cavity, the latch member including a cam surface, the other of the cavity and the cassette including a corresponding surface for contacting the cam surface of the latch member;

a rotating handle connected with the latch member for effecting a rotating movement thereof, the latch member rotating between a latching position and a non-latching position, the latch member extending from the latch slot when the latch member is rotated from the non-latching position to the latching position for progressively extending the cam surface from the latch slot, the cam surface and the corresponding surface cooperating during rotation of the latch member to progressively pull the cassette into the cavity.

22. The printer of claim 21 wherein one of the cassette and the cavity includes a latch stud extending therefrom, and the other of the cassette and the cavity includes a latch opening aligned with the latch stud, the latch stud positioned within the latch opening.

23. The printer of claim 21, further comprising:

a print head assembly located toward a label exit side of the cassette receiving cavity; and a door on a label exit side of the housing moveable between a closed position and an open position, the door providing access to the print head assembly when in the open position.

24. The printer of claim 21 wherein the cavity includes at least one guide post extending from an inner side thereof, and the cassette includes an opening for receiving the guide post.

25. The printer of claim 24 wherein the guide post receiving opening in the cassette is defined by a boss which extends within the housing.

26. A printer for printing labels, comprising:

a housing defining a cavity;

a cassette positioned within the cavity, the cassette containing a supply roll of label stock;

a print head assembly including a label stock feed roller for feeding label stock past a print head;

a tensioner arm positioned along a label stock path between the supply roll and the print head assembly, the tensioner arm contacting the label stock, the tensioner arm being flexible to vary a label stock path according to a tension in the label stock during feed for maintaining a desired feed in of the label stock.

27. A printer, comprising:

a housing having a cassette receiving cavity;

a slot positioned along a peripheral surface of the cavity;

a cassette latch member positioned within the slot for holding a cassette within the cavity;

a handle connected with the latch member for effecting movement thereof, the latch member movable between a latching position and a non-latching position, the latch member extending from the slot into the cavity when in the latching position, wherein the handle extends adjacent an outwardly facing side of a cassette inserted within the cavity when the latch member is in the latching position, the handle moved to a position non-adjacent the outwardly facing side of the cassette when the latch member is on the non-latching position for permitting removal of the cassette.

* * * * *